US009158249B2

(12) United States Patent
Arizumi et al.

(10) Patent No.: US 9,158,249 B2
(45) Date of Patent: Oct. 13, 2015

(54) FIXING MEMBER HAVING MULTIPLE ELASTIC LAYERS INCLUDING HEAT CONDUCTIVE FILLER, FIXING DEVICE, AND IMAGE FORMING APPARATUS

(71) Applicants: Yuko Arizumi, Kanagawa (JP); Tomoaki Sugawara, Kanagawa (JP); Tsuneaki Kondoh, Kanagawa (JP); Junichiro Natori, Kanagawa (JP)

(72) Inventors: Yuko Arizumi, Kanagawa (JP); Tomoaki Sugawara, Kanagawa (JP); Tsuneaki Kondoh, Kanagawa (JP); Junichiro Natori, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/568,487

(22) Filed: Dec. 12, 2014

(65) Prior Publication Data

US 2015/0177654 A1 Jun. 25, 2015

(30) Foreign Application Priority Data

Dec. 19, 2013 (JP) ..... 2013-262151

(51) Int. Cl.
*G03G 15/20* (2006.01)

(52) U.S. Cl.
CPC ..... *G03G 15/206* (2013.01)

(58) Field of Classification Search
CPC ..... G03G 15/2057; G03G 15/206
USPC ..... 399/333
See application file for complete search history.

(56) References Cited

U.S. PATENT DOCUMENTS

| | | | | |
|---|---|---|---|---|
| 4,796,046 | A * | 1/1989 | Suzuki et al. | 399/331 |
| 2004/0069404 | A1 | 4/2004 | Kondoh | |
| 2004/0224165 | A1 | 11/2004 | Kondoh et al. | |
| 2005/0095381 | A1 | 5/2005 | Kondoh | |
| 2005/0207806 | A1 | 9/2005 | Yoshii et al. | |
| 2006/0014021 | A1 | 1/2006 | Sugawara et al. | |
| 2006/0198666 | A1 | 9/2006 | Kondoh et al. | |
| 2007/0140758 | A1 | 6/2007 | Aze et al. | |
| 2008/0069612 | A1 | 3/2008 | Nakamura et al. | |
| 2008/0213002 | A1 | 9/2008 | Katano et al. | |
| 2009/0003903 | A1 | 1/2009 | Katano et al. | |
| 2009/0022527 | A1 | 1/2009 | Nakamura et al. | |
| 2009/0067868 | A1 | 3/2009 | Arizumi et al. | |
| 2009/0263584 | A1 | 10/2009 | Katano et al. | |
| 2009/0324309 | A1 | 12/2009 | Nakamura et al. | |

(Continued)

FOREIGN PATENT DOCUMENTS

| | | |
|---|---|---|
| JP | 2007-121441 | 5/2007 |
| JP | 2008-191557 | 8/2008 |

(Continued)

*Primary Examiner* — Billy Lactaoen
(74) *Attorney, Agent, or Firm* — Cooper & Dunham LLP

(57) ABSTRACT

A fixing member including a base; a first elastic layer overlaid on an outer circumference of the base, the first elastic layer formed of a silicone rubber composition including a heat conductive filler and a micro-balloon, the heat conductive filler of the first elastic layer is a heat conductive needle shaped filler; a second elastic layer overlaid on an outer circumference of the first elastic layer, the second elastic layer formed of a silicone rubber composition including a heat conductive filler and a micro-balloon, the heat conductive filler of the second elastic layer is a heat conductive needle shaped filler and a heat conductive sphere shaped filler; and a release layer overlaid on an outer circumference of the second elastic layer. An amount of the heat conductive filler of the second elastic layer is larger than an amount of the heat conductive filler of the first elastic layer.

8 Claims, 2 Drawing Sheets

(56) References Cited

U.S. PATENT DOCUMENTS

| | | | | |
|---|---|---|---|---|
| 2010/0119269 | A1 | 5/2010 | Kondoh et al. | |
| 2010/0129123 | A1 | 5/2010 | Natori et al. | |
| 2010/0310290 | A1 | 12/2010 | Sugawara | |
| 2011/0002718 | A1 | 1/2011 | Katano et al. | |
| 2011/0013957 | A1 | 1/2011 | Katano et al. | |
| 2011/0116850 | A1* | 5/2011 | Lee et al. | 399/333 |
| 2011/0217098 | A1 | 9/2011 | Tomono et al. | |
| 2011/0229231 | A1 | 9/2011 | Kaneko et al. | |
| 2011/0268480 | A1 | 11/2011 | Katano et al. | |
| 2012/0020709 | A1* | 1/2012 | Uchiyama et al. | 399/333 |
| 2012/0135342 | A1 | 5/2012 | Katano et al. | |
| 2012/0322967 | A1 | 12/2012 | Kondoh et al. | |
| 2014/0199102 | A1 | 7/2014 | Sugawara et al. | |
| 2014/0241770 | A1 | 8/2014 | Arizumi et al. | |
| 2014/0270823 | A1 | 9/2014 | Sugawara et al. | |

FOREIGN PATENT DOCUMENTS

| | | |
|---|---|---|
| JP | 2008-197585 | 8/2008 |
| JP | 2008-268469 | 11/2008 |
| JP | 2009-092826 | 4/2009 |
| JP | 2009-229616 | 10/2009 |

* cited by examiner

FIXING MEMBER HAVING MULTIPLE ELASTIC LAYERS INCLUDING HEAT CONDUCTIVE FILLER, FIXING DEVICE, AND IMAGE FORMING APPARATUS

CROSS-REFERENCE TO RELATED APPLICATIONS

This patent application is based on and claims priority pursuant to 35 U.S.C. §119 from Japanese Patent Application No. 2013-262151, filed on Dec. 19, 2013 in the Japan Patent Office, which is hereby incorporated by reference herein in its entirety.

BACKGROUND

1. Technical Field

Exemplary embodiments of the present disclosure generally relate to a fixing member, a fixing device, and an image forming apparatus.

2. Description of the Related Art

In recent years, electrophotographic image forming apparatuses such as copiers and printers have been directed toward full-color image formation, and the ratio thereof has been gradually increasing. Typically, a color electrophotographic image forming apparatus includes an image forming unit that forms a color image formed of toner images of four colors (cyan, magenta, yellow and black) on a recording medium, and a fixing device that fixes the formed toner images to the recording medium. The fixing device includes a heater for heating the toner images on the recording medium, a fixing member for fixing the toner images to the recording medium, and a pressing member forming a fixing nip between the pressing member and the fixing member. The toner images are fixed to the recording medium by heating and pressing the toner images when the recording medium passes through the fixing nip.

The fixing member having a belt shape or a roller shape is known. The fixing member includes those formed by providing an elastic layer made of a heat-resistant rubber on a base member such as a metal roller or a resin seamless belt, and those formed by further providing a release layer on the elastic layer. Generally, fixing members having the roller shape that are employed are those integrating the heater inside a roller (i.e., heat fixing roller). Further, fixing members having the belt shape that are well known are those providing the heater inside the belt wound around rollers.

The fixing member needs to flexibly adhere to the toner images and efficiently conduct heat so that the toner images of multiple colors (usually toner images of four colors) constituting full color are evenly heated. Thus, a silicone rubber having flexibility and heat resistance is often used for the fixing member. However, silicone rubbers have low thermal conductivity, and thermal conduction to the toner image may become slower.

When thermal conduction is slow, a lot of time is required to heat a surface of the fixing member to a fixing temperature for fixing the toner images. In a case of a high-speed machine, supplying of heat may be too slow. In addition, warm-up speed of the image forming apparatus may become slow. It is important to note that the warm-up speed with respect to temperature increase of the fixing member of the fixing device often limits the rate of warm-up speed of the image forming apparatus, as a whole, when powered on.

As a method to resolve the above-described problems, a technique for shortening the warm-up time (i.e., warm-up speed) of the image forming apparatus is disclosed in related art. In the technique, thermal conductivity of the elastic layer is enhanced by blending carbon fibers in the silicone rubber, and thermal capacity of the elastic layer is reduced by providing hole portions in the silicone rubber. The above-described technique is effective with respect to obtaining high heat dispersion. In addition, by making a thickness of the fixing member thin or by making the fixing belt or the fixing roller have a small diameter, further shortening of warm-up time of the image forming apparatus may be obtained. However, in a case of the fixing member having a small diameter and thin thickness, a heat storage amount is small. Accordingly, if supplying of heat to the fixing nip is not on time, an amount of heat at the surface of the fixing member may be insufficient and fixing performance may decline. In a case of a high-speed machine provided with the fixing member having the small diameter and thin thickness, warm-up speed is fast. However, in an operation of continuously passing through the recording medium through the fixing nip, fixing failure or uneven gloss of an image is generated. More specifically, there is an issue of image failure caused by a lack of the amount of heat at the surface of the fixing member.

A method to resolve the lack of the amount of heat at the surface of the fixing member is disclosed in related art. For example, providing a high thermal conductive layer on a surface layer of the fixing roller, and heating the fixing roller from the outside. With a configuration of the above-described example, heat dispersion is enhanced by the high thermal conductive layer. However, in the configuration, the high thermal conductive layer is a solid silicone rubber or a fluororesin with heat conductive fillers. Accordingly, flexibility of the fixing roller is low. Thus, there is an issue of uneven gloss caused by a lack of following capability of the fixing roller with respect to the toner image.

As described above, the fixing member capable of high-speed warm-up and having good fixing performance is unavailable.

SUMMARY

In view of the foregoing, in an aspect of this disclosure, there is provided a novel fixing member used for fixing toner, including a base; a first elastic layer overlaid on an outer circumference of the base, the first elastic layer formed of a silicone rubber composition including a heat conductive filler and a micro-balloon, the heat conductive filler of the first elastic layer is a heat conductive needle shaped filler; a second elastic layer overlaid on an outer circumference of the first elastic layer, the second elastic layer formed of a silicone rubber composition including a heat conductive filler and a micro-balloon, the heat conductive filler of the second elastic layer is a heat conductive needle shaped filler and a heat conductive sphere shaped filler; and a release layer overlaid on an outer circumference of the second elastic layer. An amount of the heat conductive filler of the second elastic layer in the silicone rubber composition of the second elastic layer is larger than an amount of the heat conductive filler of the first elastic layer in the silicone rubber composition of the first elastic layer.

These and other aspects, features, and advantages will be more fully apparent from the following detailed description of illustrative embodiments, the accompanying drawings, and associated claims.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
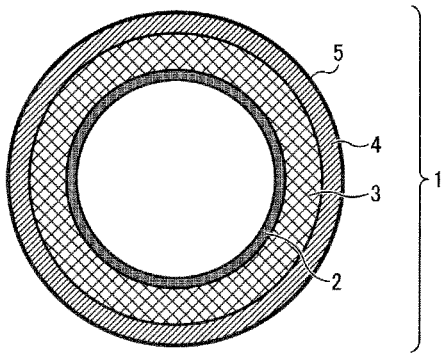
FIG. 1 is a cross-sectional view of an example of the fixing member according to an embodiment of the present invention.

The accompanying drawings are intended to depict exemplary embodiments of the present disclosure and should not be interpreted to limit the scope thereof, The accompanying drawings are not to be considered as drawn to scale unless explicitly noted.

DETAILED DESCRIPTION

Hereinafter, exemplary embodiments of the present invention are described in detail with reference to the drawings. However, the present invention is not limited to the exemplary embodiments described below, but may be modified and improved within the scope of the present disclosure.

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

In a later-described comparative example, illustrative embodiment, and alternative example, for the sake of simplicity, the same reference numerals will be given to constituent elements such as parts and materials having the same functions, and redundant descriptions thereof omitted.

Within the context of the present disclosure, if a second layer is stated to be "overlaid." on, or "overlying" a first layer, the second layer may be in direct contact with a portion or all of the first layer, or there may be one or more intervening layers between the first and second layer, with the first layer being closer to a base than the second layer.

There is provided a novel fixing member that is capable of warming-up at high speed and suppresses generation of image failure, a fixing device, and an image forming apparatus.

<Fixing Member>

FIG. 1 is a cross-sectional view of an example of the fixing member according to an embodiment of the present invention. The fixing member of FIG. I may have any shape such as a roller, a belt, or a sheet. As shown in FIG. 1, a fixing member 1 includes a base 2, a first elastic layer 3 overlaid on an outer circumference of the base 2, a second elastic layer 4 overlaid on an outer circumference of the first elastic layer 3, and a release layer 5 overlaid on an outer circumference of the second elastic layer 4. A primer layer may be provided between individual layers of the fixing member 1 as needed.

Figure 2:
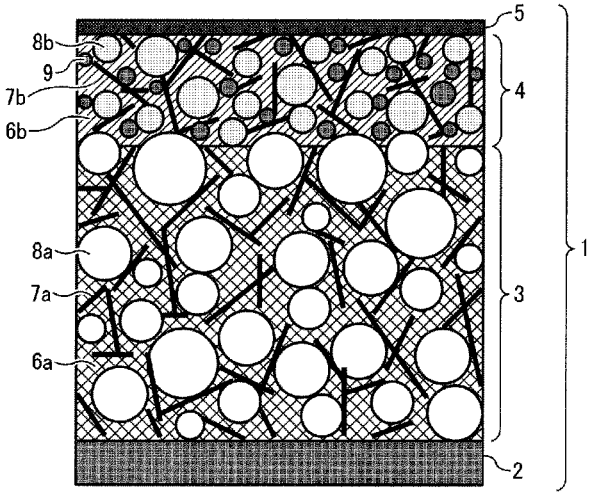
FIG. 2 is an enlarged view of a fine structure of the example of the fixing member in FIG. 1.

FIG. 2 is an enlarged view of a fine structure of the example of the fixing member 1 in FIG. 1. The first elastic layer 3 is a silicone rubber composition configured of a first silicone rubber 6*a*, first heat conductive needle shaped fillers 7*a*, and first micro-balloons 8*a*. The second elastic layer 4 is a silicone rubber composition configured of a second silicone rubber 6*b*, second heat conductive needle shaped fillers 7*b*, second micro-balloons 8*b*, and heat conductive sphere shaped fillers 9.

[Silicone Rubber]

There is no restriction regarding a silicone rubber employed for the first silicone rubber 6*a* and the second silicone rubber 6*b* as long as the employed silicone rubber includes an organosiloxane structure. Specific examples of the silicone rubber include, but are not limited to, KE-1950-30 (from Shin-Etsu Chemical Co., Ltd.) and DY35-2083 (from Dow Corning Toray Co., Ltd.). Among the silicone rubbers, an addition-type liquid silicone rubber having a hardening temperature in a range from approximately 90° C. to 140° C. offers good workability and is preferable.

[Heat Conductive Fillers]

There is no restriction regarding employed heat conductive fillers as long as the heat conductive fillers exhibit thermal conductivity that is higher than the silicone rubber employed for the first silicone rubber 6*a* and the second silicone rubber 6*b*. Preferably, the heat conductive fillers have a sphere shape, a granular shape, a shape of a polyhedron, or a needle shape with an aspect ratio (length/diameter) of 2.5 or more.

[Heat Conductive Needle Shaped Fillers]

Specific examples of heat conductive needle shaped fillers employed for the first heat conductive needle shaped fillers 7*a* and the second heat conductive needle shaped fillers 7*b* include, but are not limited to, carbon fibers, silicon carbide, aluminum nitride, boron nitride, silicon nitride, zinc oxide, magnesium oxide, and alumina. The needle shape is defined as a long and narrow shape with the aspect ratio of 2.5 or more.

Among the above-described examples, carbon fibers are preferable due to being light weight and having good thermal conductivity. Carbon fibers may be obtained by carbonizing a precursor (raw material of carbon fibers formed into fibers).

Carbon fibers include, depending on manufacturing conditions, pitch-based carbon fibers and PAN-based (polyacrylonitrile) carbon fibers. Specific examples of pitch-based carbon fibers include, but are not limited to, GRANOC® XN-100-05M and XN-100-15M (from Nippon Graphite Fiber Corporation); DIALEAD® K223QM, K6361M, and K223HM (from Mitsubishi Plastics, Inc.); and DONACARBO Middle S-2404, S-249, S-241, and SG-249 (from Osaka Gas Chemicals Co., Ltd.).

Specific examples of PAN-based carbon fibers include, but are not limited to, TORAYCA® Milled Fibers MLD-30, MLD-300, and MLD-1000 (from Toray Industries, Inc.); and PYROFIL® Chopped Fibers (from Mitsubishi Rayon Co., Ltd.). Pitch-based carbon fibers have superior thermal conductivity compared to PAN-based carbon fibers and are preferable.

In addition, carbon nanotubes having a large aspect ratio or carbon nano-fibers with a fiber diameter of 500 nm or less can also be employed as carbon fibers.

In the fixing member 1 according to an embodiment of the present invention, contacting portions among the first heat conductive needle shaped fillers 7*a* in the first elastic layer 3 and contacting portions among the second heat conductive needle shaped fillers 7*b* in the second elastic layer 4; provided around the first micro-balloons 8*a* and the second micro-balloons 8*b* that are for reducing thermal capacity, are paths of thermal conduction.

Preferably, the first heat conductive needle shaped fillers 7*a* and the second heat conductive needle shaped fillers 7*b* have an average fiber length in a range from 1 μm to 500 μm. If the average fiber length is abnormally short, there are cases in which the first heat conductive needle shaped fillers 7*a* and the second heat conductive needle shaped fillers 7*b* do not contribute to enhancement of thermal conductivity. If the average fiber length is too long, decline of flexibility or decline of smoothness of a surface of the fixing member 1 may occur.

[Heat Conductive Sphere Shaped Fillers]

Specific examples of the heat conductive sphere shaped fillers 9 include, but are not limited to, sphere shaped graphite, silicon carbide, aluminum nitride, boron nitride, silicon nitride, zinc oxide, magnesium oxide, alumina, and metal silicon. The sphere shape is defined as a circular shape with an aspect ratio in a range from 1.0 to 1.5.

Among the above-described examples, sphere shaped graphite is preferable due to being light weight and having good thermal conductivity. Specific examples of sphere shaped graphite include, but are not limited to, WF-15C (from Chuetsu Graphite Works Co., Ltd.); and SG-BH8, SG-BH, SG-BL30, and SG-BL40 (from Ito Graphite Co., Ltd.).

Aluminum nitride and boron nitride also have good thermal conductivity and are preferable. Specific examples of aluminum nitride include, but are not limited to, powder aluminum nitride for fillers (from Tokuyama Corporation); FAN-f30 and FAN-f50 (from Furukawa Denshi Co., Ltd.); and JCG (from Toyo Aluminium K.K.). Specific examples of boron nitride include, but are not limited to, SHOBN® UHP-EX (from Showa Denko K.K.).

Adding the heat conductive sphere shaped fillers 9 to the second elastic layer 4 enhances thermal conductivity of the second elastic layer 4 without reducing flexibility of the second elastic layer 4.

Preferably, the heat conductive sphere shaped fillers 9 have an average particle diameter in a range from 0.1 μm to 50 μm. If the average particle diameter of the heat conductive sphere shaped fillers 9 is too small, there are cases in which the heat conductive sphere shaped fillers 9 do not contribute to enhancement of thermal conductivity. If the average particle diameter of the heat conductive sphere shaped fillers 9 is too large, decline of flexibility or decline of smoothness of the surface of the fixing member 1 may occur.

An addition amount of the heat conductive fillers, with respect to 100 parts by weight of the silicone rubber, is preferably in a range from 1 part by weight to 60 parts by weight, and more preferably in a range from 5 parts by weight to 50 parts by weight. If the addition amount of the heat conductive fillers is less than 1 part by weight, enhancement of thermal conductivity is not obtained. If the addition amount of the heat conductive fillers exceeds 60 parts by weight, strength, flexibility, or smoothness of a surface of a formed fixing member declines and is unfavorable.

In a case of employing a combination of the heat conductive needle shaped fillers and the heat conductive sphere shaped fillers 9, decline of flexibility is suppressed compared to a case of employing the heat conductive needle shaped fillers singularly. In addition, thermal conductivity is higher in the case of employing the above-described combination compared to the case of employing the heat conductive needle shaped fillers singularly. Thus, by making a layer at an outer side of the fixing member 1 include the combination of the heat conductive needle shaped fillers and the heat conductive sphere shaped fillers 9, high heat dispersion of the fixing member 1 and good following capability of the fixing member 1 with respect to a toner image are obtained.

In the case of employing the combination of the heat conductive needle shaped fillers and the heat conductive sphere shaped fillers 9, a mixture ratio of the heat conductive needle shaped fillers:the heat conductive sphere shaped fillers 9 is preferably in a range from 10:1 to 10:10, and more preferably in a range from 10:1 to 10:6.

When a total amount of the second heat conductive needle shaped fillers 7*b* and the heat conductive sphere shaped fillers 9 in the second elastic layer 4 is larger than an amount of the first heat conductive needle shaped fillers 7*a* in the first elastic layer 3, the second elastic layer 4 provided at the outer side of the fixing member 1 attains higher heat dispersion and high heat storage. Accordingly, sufficient supplying of heat to a nip by the fixing member 1 is obtained and is preferable.

[Micro-Balloons]

There is no restriction regarding micro-balloons employed for the first micro-balloons 8*a* and the second micro-balloons 8*b* as long as the employed micro-balloons are hollow bodies with a diameter in a range from 5 μm to 300 μm. Examples of the micro-balloons include, according to an outer shell component of the micro-balloons, plastic balloons, glass balloons, silica balloons, and carbon balloons. Specific examples of the micro-balloons include, but are not limited to, Matsumoto Microsphere® F-30, F-36, F-50, F-55, F-80SDE, FN-80SDE, F-65DE, and F-80DE (from Matsumoto Yushi-Seiyaku Co., Ltd.); and Expancel® 053-40, 031-40, 551DE40d42, 9200E40d30, and EMC40(B) (from Japan Fillite Co., Ltd.). Among the micro-balloons, plastic balloons are preferable due to being light weight and having high elasticity. Plastic balloons expand with heat and form hollow portions in an elastic layer (i.e., the first elastic layer 3, the second elastic layer 4) when the elastic layer is heat-molded.

Further, unexpanded plastic balloons may be expanded to form pre-expanded plastic balloons and then blended to the elastic layer. The pre-expanded plastic balloons are preferable because the pre-expanded plastic balloons have already expanded, and shape and volume of the pre-expanded plastic balloons are difficult to change during a molding process and excellent dimensional accuracy is obtained.

An addition amount of the micro-balloons, with respect to 100 parts by weight of the silicone rubber, is preferably in a range from 0.1 parts by weight to 5 parts by weight, and more preferably in a range from 0.5 parts by weight to 3 parts by weight. If the addition amount of the micro-balloons is less than 0.1 parts by weight, reduction of thermal capacity is not obtained. If the addition amount of the micro-balloons exceeds 5 parts by weight, strength or smoothness of a surface of a formed fixing member declines and is unfavorable.

[Other Raw Materials for Elastic Layer Composition]

The composition of the elastic layer may be adjusted by mixing, kneading, and dispersing carbon fibers and micro-balloons with the silicone rubber. A publicly known cross-linking agent, a filler, a conductive agent, a degradation preventing agent for rubber and plastic materials, and a heat-resistant agent may be added to the elastic layer according to objective as long as the effect of the present invention is not impaired.

[Formation of the Elastic Layer]

There is no restriction regarding a method for forming the elastic layer (i.e., the first elastic layer 3, the second elastic layer 4) and may be arbitrarily selected according to objective.

For example, a method of coating constituents of the elastic layer by blade coating, die coating, and dip coating and hardening the constituents of the elastic layer with heat or electron beam may be used.

A total thickness of the first elastic layer 3 and the second elastic layer 4 is preferably in a range from 0.05 mm to 4 mm, and more preferably in a range from 0.1 mm to 2 mm. When the total thickness is less than 0.05 mm, a sufficient fixing nip width may not be formed. When the total thickness exceeds 4 mm, decline in thermal conductivity or enhancement in thermal capacity occurs and speeding up of the image forming apparatus or swiftness of warm-up time (warm-up speed) may be influenced.

Preferably, thickness of the second elastic layer 4 is half or less of thickness of the first elastic layer 3. Accordingly, the fixing member 1 having both flexibility and high heat dispersion is obtained.

[Base]

Specific examples of a material for the base 2 include, but are not limited to, a resin such as polyimide, polyamideimide, polyether ether ketone, polyether sulfone, polyphenylene sulfide, and fluororesin; a resin obtained by dispersing magnetic conductive particles in one of the above-described resins; a metal such as nickel, stainless steel, iron, aluminum, and copper; and an alloy of the above-described metals.

There is no restriction regarding a method for forming the base 2, and may be arbitrarily selected according to objective.

For example, a method of molding the material for the base 2 with a mold may be employed.

A thickness of the base 2 is preferably in a range from 20 μm to 500 μm, and more preferably in a range from 40 μm to 150 μm. When the thickness is less than 20 μm, decline in strength of the base 2 may occur. When the thickness exceeds 500 μm, enhancement in thermal capacity occurs and speeding up of the image forming apparatus or swiftness of warm-up time may be influenced.

[Release Layer]

A fluororesin may be employed as the release layer 5. Specific examples of the fluororesin include, but are not limited to, low molecular weight polytetrafluoroethylene (PTFE), tetrafluoroethylene-hexafluoropropylene copolymer (FEP), and tetrafluoroethylene-perfluoroalkyl-vinylether copolymer (PFA). Specific examples of PTFE include, but are not limited to, LUBRON L-5 and L-2 (from Daikin Industries, Ltd.); and MP1100, MP1200, MP1300, and TLP-10F-1 (from DuPont-Mitsui Fluorochemicals, Co., Ltd.). Specific examples of the FEP include, but are not limited to, 532-8000 (from DuPont). Specific examples of PFA include, but are not limited to, AC-5600 and AC5539 (from Daikin Industries, Ltd.); and MP-102, MP-103, MP-300, 350-J, 451HP-J, and 950HP-Plus (from DuPont-Mitsui Fluorochemicals, Co., Ltd.). A specific example of PFA-FEP is, but is not limited to, SMT (from Gunze Limited). A fluororesin having a relatively low melting point (preferably, in a range from 250° C. to 300° C.) offers good workability and is preferable.

In addition, a fluorosilicone rubber may be used for the release layer 5.

There is no restriction regarding a method for forming the release layer 5, and may be arbitrarily selected according to objective.

For example, a method of forming a material of the release layer 5 into a tube shape and covering the second elastic layer 4, or a method of firing after wet spray coating or particle coating the material of the release layer 5 may be employed.

A thickness of the release layer 5 is preferably in a range from 0.5 μm to 50 μm, and more preferably in a range from 1 μm to 30 μm. When the thickness is less than 0.5 μm, durability of the release layer 5 is poor and obtaining sufficient smoothness of the surface of the fixing member 1 becomes difficult. By contrast, when the thickness exceeds 50 μm, decline in image following capability and enhancement of heat transfer resistance may occur and is unfavorable.

<Fixing Device>

Figure 3:
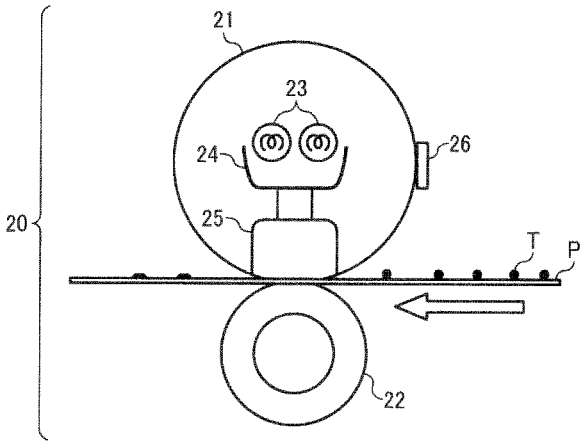
FIG. 3 is a schematic view of an example of a configuration of a fixing device (e.g. belt type) according to an embodiment of the present invention.

FIG. 3 is a schematic view of an example of a configuration of the fixing device (e.g. belt type) according to an embodiment of the present invention. In FIG. 3, a belt type fixing device 20 includes a fixing belt 21 serving as the fixing member according to an embodiment of the present invention, and a pressure roller 22. A heater 23 such as a halogen lamp serving as a heater, a reflecting plate 24, and a pad 25 for pressure application are provided inside the fixing belt 21. A temperature sensor 26 is provided adjacent to the fixing belt 21. A nip for fixing is formed between the fixing belt 21 and the pressure roller 22 that presses and contacts the fixing belt 21. When a recording medium P passes through the nip; a toner image T on the recording medium P is fixed to the recording medium P. The fixing belt 21 includes an elastic layer and a release layer overlaid on a surface of a core metal serving as a base in a sequence of the elastic layer and the release layer, and has the same structure as the fixing member 1 shown in FIG. 1 and FIG. 2. The pressure roller 22 includes an elastic layer and a release layer formed of a heat-resistant rubber overlaid on a surface of a cored bar serving as a base in a sequence of the elastic layer and the release layer.

The fixing device according to an embodiment of the present invention employs the fixing member according to an embodiment of the present invention, and thus is capable of high-speed warm-up and suppresses generation of image failure.

<Image Forming Apparatus>

Figure 4:
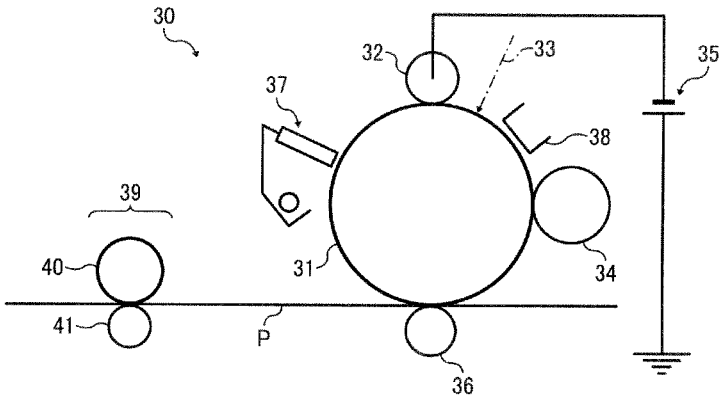
FIG. 4 is a schematic view of an example of a configuration of an image forming apparatus according to an embodiment of the present invention.

FIG. 4 is a schematic view of an example of a configuration of the image forming apparatus according to an embodiment of the present invention. In FIG. 4, an image forming apparatus 30 includes an image forming unit for forming a toner image and transferring the toner image onto a recording medium P, and a fixing device 39 for fixing the transferred image to the recording medium P.

The image forming unit includes an image carrier 31 on which an electrostatic latent image is formed, a charging roller 32 that contacts the image carrier 31 and conducts charging, an exposure device 33 such as a laser, a developing roller 34 that attaches toner to the electrostatic latent image formed on the image carrier 31, a power source 35 that applies a DC voltage to the charging roller 32, a transfer roller 36 that transfers the toner image on the image carrier 31 onto the recording medium P, a cleaning device 37 that cleans the image carrier 31 after transfer of the toner image, and a surface potentiometer 38 that measures a surface potential of the image carrier 31. The fixing device 39 is the fixing device according to an embodiment of the present invention and is configured of a fixing belt 40 and a pressure roller 41.

In the image forming apparatus 30 according to an embodiment of the present invention shown in FIG. 4, the image forming apparatus 30 conducts uniform charging of a photoconductive layer of the rotating image carrier 31 with the charging roller 32, forms an electrostatic latent image on the photosensitive layer by exposing the photoconductive layer with the exposure device 33 such as the laser, develops the electrostatic latent image to form the toner image by attaching toner with the developing roller 34, and transfers the toner image onto the recording medium P. The toner image on the recording medium P is pressed and contacted to the recording medium P at a nip formed between the fixing belt 40 and the pressure roller 41 of the fixing device 39. The toner image on the recording medium P is fixed to the recording medium P due to softening of the toner image with heat of the fixing belt 40 and application of pressure. The recording medium P is then discharged to a discharge space. In the image forming apparatus 30, the fixing belt 40 is the fixing member according to an embodiment the present invention.

The image forming apparatus according to an embodiment of the present invention employs the fixing device according to an embodiment of the present invention, and thus is capable of high-speed warm-up and suppresses generation of image failure.

EXAMPLES

Further understanding can be obtained by reference to specific examples, which are provided hereinafter. However, it is to be understood that the embodiments of the present invention are not limited to the following examples.

Example 1

[Manufacture of a Fixing Member]

Step A-1: A primer for silicone is coated on a cylindrical shaped stainless steel base (with a diameter of 30 mm and a thickness of 40 μm) and dried.

Step B-1: A silicone rubber composition 1-1 is prepared by dispersing 100 parts by weight of a silicone rubber of DY35-2083 (from Dow Corning Toray Co., Ltd.), 40 parts by weight of carbon fibers of GRANOC® XN-100-05M (from Nippon Graphite Fiber Corporation), and 1.5 parts by weight of micro-balloons of Expancel® 920DE40d30 (from Japan Fillite Co., Ltd.). Next, the silicone rubber composition 1-1 is coated on the formed cylindrical shaped stainless steel base of step A-1, heated and hardened for 30 minutes at a temperature of 120° C., and a first elastic layer having a thickness of 150 μm is formed.

Step C-1: A silicone rubber composition 1-2 is prepared by dispersing 100 parts by weight of a silicone rubber of DY35-2083 (from Dow Corning Toray Co., Ltd.), 40 parts by weight of carbon fibers of GRANOC® XN-100-05M (from Nippon Graphite Fiber Corporation), 10 parts by weight of sphere shaped graphite of WF-15C (from Chuetsu Graphite Works Co., Ltd.), 1.5 parts by weight of micro-balloons of Expancel® 920DE40d30 (from Japan Fillite Co., Ltd.), and 10 parts by weight of dodecane. Next, the silicone rubber composition 1-2 is coated on the formed first elastic layer of step B-1, heated and hardened for 30 minutes at a temperature of 120° C., and a second elastic layer having a thickness of 100 μm is formed.

Step D-1: A primer for silicone is coated on the formed second elastic layer of step C-1. Then, the formed second elastic layer of step C-1 with the primer is covered with a fluororesin tube of 350-1 (from DuPont-Mitsui Fluorochemicals, Co., Ltd.), heated for 10 minutes at a temperature of 300° C., and a release layer having a thickness of 15 μm is formed.

Accordingly, a fixing member of Example 1 is prepared.

[Evaluation]

The fixing member of Example 1 obtained as described above is set in a fixing device of an image forming apparatus, Imagio MP C5002 (from RICOH Company, Ltd.), and a warm-up time from power ON to enablement of copying is measured. Next, a test of printing a solid image on both sides of an A4 size, vertical orientation, recording medium is conducted, 500 sheets of the A4 size recording medium are passed through the fixing device. Gloss unevenness of the solid images is visually evaluated and ranked. The employed recording medium is a full-color PPC sheet, type 6000 <90W> (from RICOH Company, Ltd.).

Example 2

[Manufacture of a Fixing Member]

Step A-2: The procedure of step A-1 of Example 1 is repeated and a base of Example 2 is formed.

Step B-2: A silicone rubber composition 2-1 is prepared by dispersing 100 parts by weight of a silicone rubber of DY35-2083 (from Dow Corning Toray Co., Ltd.), 40 parts by weight of carbon fibers of GRANOC® XN-100-05M (from Nippon Graphite Fiber Corporation), and 1.2 parts by weight of micro-balloons of Expancel® 920DE80d30 (from Japan Fillite Co., Ltd.). Next, the silicone rubber composition 2-1 is coated on the base of step A-2, heated and hardened for 30 minutes at a temperature of 120° C., and a first elastic layer having a thickness of 200 μm is formed.

Step C-2: A silicone rubber composition 2-2 is prepared by dispersing 100 parts by weight of a silicone rubber of DY35-2083 (from Dow Corning Toray Co., Ltd.), 45 parts by weight of carbon fibers of GRANOC® XN-100-05M (from Nippon Graphite Fiber Corporation), 15 parts by weight of sphere shaped graphite of WF-15C (from Chuetsu Graphite Works Co., Ltd.), 1.2 parts by weight of micro-balloons of Expancel® 551DE40d42 (from Japan Fillite Co., Ltd.), and 10 parts by weight of dodecane. Next, the silicone rubber composition 2-2 is coated on the formed first elastic layer of step B-2, heated and hardened for 30 minutes at a temperature of 120° C., and a second elastic layer having a thickness of 100 μg is formed.

Step D-2: The procedure of step D-1 of Example 1 is repeated and a release layer is formed on the second elastic layer formed in step C-2.

Accordingly, a fixing member of Example 2 is prepared.

[Evaluation]

The evaluation of Example 1 is repeated for Example 2 employing the fixing member of Example 2 instead of the fixing member of Example 1. A warm-up time is measured, and after conducting test printing, gloss unevenness is visually evaluated and ranked.

Example 3

[Manufacture of a Fixing Member]

Step A-3: The procedure of step A-1 of Example 1 is repeated and a base of Example 3 is formed.

Step B-3: A silicone rubber composition 3-1 is prepared by dispersing 100 parts by weight of a silicone rubber of DY35-2083 (from Dow Corning Toray Co., Ltd.), 40 parts by weight of carbon fibers of GRANOC® XN-100-05M (from Nippon Graphite Fiber Corporation), and 1.5 parts by weight of micro-balloons of Matsumoto Microsphere® F-65DE (from Matsumoto Yushi-Seiyaku Co., Ltd.). Next, the silicone rubber composition 3-1 is coated on the base of step A-3, heated and hardened for 30 minutes at a temperature of 120° C., and a first elastic layer having a thickness of 200 μm is formed.

Step C-3: A silicone rubber composition 3-2 is prepared by dispersing 100 parts by weight of a silicone rubber of DY35-2083 (from Dow Corning Toray Co., Ltd.), 40 parts by weight of carbon fibers of GRANOC® XN-100-05M (from Nippon Graphite Fiber Corporation), 20 parts by weight of sphere shaped graphite of SG-BH8 (from Ito Graphite Co., Ltd.), 1.2 parts by weight of micro-balloons of Matsumoto Microsphere® FN-80SDE (from Matsumoto Yushi-Seiyaku Co., Ltd.), and 10 parts by weight of dodecane. Next, the silicone rubber composition 3-2 is coated on the formed first elastic layer of step B-3, heated and hardened for 30 minutes at a temperature of 120° C., and a second elastic layer having a thickness of 50 μm is formed.

Step D-3: The procedure of step D-1 of Example 1 is repeated and a release layer is formed on the second elastic layer formed in step C-3.

Accordingly, a fixing member of Example 3 is prepared.

[Evaluation]

The evaluation of Example 1 is repeated for Example 3 employing the fixing member of Example 3 instead of the fixing member of Example 1. A warm-up time is measured, and after conducting test printing, gloss unevenness is visually evaluated and ranked.

Example 4

[Manufacture of a Fixing Member]

Step A-4: The procedure of step A-1 of Example 1 is repeated and a base of Example 4 is formed.

Step B-4: A silicone rubber composition 4-1 is prepared by dispersing 100 parts by weight of a silicone rubber of DY35-2083 (from Dow Corning Toray Co., Ltd.), 40 parts by weight of carbon fibers of DIALEAD® K223HM (average fiber length 50 μm, from Mitsubishi Plastics, Inc.), and 1.2 parts by weight of micro-balloons of Matsumoto Microsphere® F-80DE (from Matsumoto Yushi-Seiyaku Co., Ltd.). Next, the silicone rubber composition 4-1 is coated on the base of step A-4, heated and hardened for 30 minutes at a temperature of 120° C., and a first elastic layer having a thickness of 200 μm is formed.

Step C-4: A silicone rubber composition 4-2 is prepared by dispersing 100 parts by weight of a silicone rubber of DY35-2083 (from Dow Corning Toray Co., Ltd.), 40 parts by weight of carbon fibers of DIALEAD® K223HM (average fiber length 50 μm, from Mitsubishi Plastics, Inc.), 10 parts by weight of sphere shaped graphite of SG-BL30 (from Ito Graphite Co., Ltd.), 1.0 part by weight of micro-balloons of Matsumoto Microsphere® FN-80SDE (from Matsumoto Yushi-Seiyaku Co., Ltd.), and 5 parts by weight of dodecane. Next, the silicone rubber composition 4-2 is coated on the formed first elastic layer of step B-4, heated and hardened for 30 minutes at a temperature of 120° C., and a second elastic layer having a thickness of 100 μm is formed.

Step D-4: The procedure of step D-1 of Example 1 is repeated and a release layer is formed on the second elastic layer formed in step C-4.

Accordingly, a fixing member of Example 4 is prepared,

[Evaluation]

The evaluation of Example 1 is repeated for Example 4 employing the fixing member of Example 4 instead of the fixing member of Example 1. A warm-up time is measured, and after conducting test printing, gloss unevenness is visually evaluated and ranked.

Example 5

[Manufacture of a Fixing Member]

Step A-5: The procedure of step A-1 of Example 1 is repeated and a base of Example 5 is formed.

Step B-5: A silicone rubber composition 5-1 is prepared by dispersing 100 parts by weight of a silicone rubber of DY35-2083 (from Dow Corning Toray Co., Ltd.), 40 parts by weight of carbon fibers of DIALEAD® K223HM (average fiber length 50 μm, from Mitsubishi Plastics, Inc.), and 1.5 parts by weight of micro-balloons of Matsumoto Microsphere® F-65DE (from Matsumoto Yushi-Seiyaku Co., Ltd.). Next, the silicone rubber composition 5-1 is coated on the base of step A-5, heated and hardened for 30 minutes at a temperature of 120° C., and a first elastic layer having a thickness of 200 μm is formed.

Step C-5: A silicone rubber composition 5-2 is prepared by dispersing 100 parts by weight of a silicone rubber of DY35-2083 (from Dow Corning Toray Co., Ltd.), 40 parts by weight of carbon fibers of DIALEAD® K223HM (average fiber length 50 μm, from Mitsubishi Plastics, Inc.), 5 parts by weight of aluminum nitride of FAN-f30 (sphere shaped, from Furukawa Denshi Co., Ltd.), and 1.5 parts by weight of micro-balloons of Matsumoto Microsphere® FN-80SDE (from Matsumoto Yushi-Seiyaku Co., Ltd.), and 5 parts by weight of dodecane. Next, the silicone rubber composition 5-2 is coated on the formed first elastic layer of step B-5, heated and hardened for 30 minutes at a temperature of 120° C., and a second elastic layer having a thickness of 50 μm is formed.

Step D-5: The procedure of step D-1 of Example 1 is repeated and a release layer is formed on the second elastic layer formed in step C-5.

Accordingly, a fixing member of Example 5 is prepared.

[Evaluation]

The evaluation of Example 1 is repeated for Example 5 employing the fixing member of Example 5 instead of the fixing member of Example 1. A warm-up time is measured, and after conducting test printing, gloss unevenness is visually evaluated and ranked.

Example 6

[Manufacture of a Fixing Member]

Step A-6: The procedure of step A-1 of Example 1 is repeated and a base of Example 6 is formed.

Step B-6: A silicone rubber composition 6-1 is prepared by dispersing 100 parts by weight of a silicone rubber of DY35-2083 (from Dow Corning Toray Co., Ltd.), 35 parts by weight of carbon fibers of GRANOC® XN-100-05M (from Nippon Graphite Fiber Corporation), 5 parts by weight of carbon nano-fibers of VGCF®-H (from Showa Denko K.K.), 1.0 part by weight of micro-balloons of Matsumoto Microsphere® F-65DE (from Matsumoto Yushi-Seiyaku Co., Ltd.), and 10 parts by weight of dodecane. Next, the silicone rubber composition 6-1 is coated on the base of step A-6, heated and hardened for 30 minutes at a temperature of 120° C., and a first elastic layer having a thickness of 200 μm is formed.

Step C-6: A silicone rubber composition 6-2 is prepared by dispersing 100 parts by weight of a silicone rubber of DY35-2083 (from Dow Corning Toray Co., Ltd.), 35 parts by weight of carbon fibers of GRANOC® XN-100-05M (from Nippon Graphite Fiber Corporation), 5 parts by weight of carbon nano-fibers of VGCF®-H (from Showa Denko K.K.), 5 parts by weight of aluminum nitride of JCG (from Toyo Aluminium K.K.), 1.0 part by weight of micro-balloons of Matsumoto Microsphere® FN-80SDE (from Matsumoto Yushi-Seiyaku Co., Ltd.), and 15 parts by weight of dodecane. Next, the silicone rubber composition 6-2 is coated on the formed first elastic layer of step B-6, heated and hardened for 30 minutes at a temperature of 120° C., and a second elastic layer having a thickness of 100 μm is formed.

Step D-6: The procedure of step D-1 of Example 1 is repeated and a release layer is formed on the second elastic layer formed in step C-6.

Accordingly, a fixing member of Example 6 is prepared.

[Evaluation]

The evaluation of Example 1 is repeated for Example 6 employing the fixing member of Example 6 instead of the fixing member of Example 1. A warm-up time is measured, and after conducting test printing, gloss unevenness is visually evaluated and ranked.

Example 7

[Manufacture of a Fixing Member]

Step A-7: The procedure of step A-1 of Example 1 is repeated and a base of Example 7 is formed.

Step B-7: A silicone rubber composition 7-1 is prepared by dispersing 100 parts by weight of a silicone rubber of DY35-2083 (from Dow Corning Toray Co., Ltd.), 35 parts by weight of carbon fibers of GRANOC® XN-100-05M (from Nippon Graphite Fiber Corporation), 5 parts by weight of carbon nano-fibers of VGCF®-H (from Showa Denko K.K.), 1.0 part by weight of micro-balloons of Matsumoto Microsphere® F-65DE (from Matsumoto Yushi-Seiyaku Co., Ltd.), and 10 parts by weight of dodecane. Next, the silicone rubber composition 7-1 is coated on the base of step A-7, heated and hardened for 30 minutes at a temperature of 120° C., and a first elastic layer having a thickness of 200 μm is formed.

Step C-7: A silicone rubber composition 7-2 is prepared by dispersing 100 parts by weight of a silicone rubber of DY35-2083 (from Dow Corning Toray Co., Ltd.), 35 parts by weight of carbon fibers of GRANOC® XN-100-05M (from Nippon Graphite Fiber Corporation), 5 parts by weight of carbon nano-fibers of VGCF®-H (from Showa Denko K.K.), 5 parts by weight of boron nitride of SHOBN UHP-EX (from Showa Denko K.K.), 1.0 part by weight of micro-balloons of Matsumoto Microsphere® FN-80SDE (from Matsumoto Yushi-Seiyaku Co., Ltd.), and 15 parts by weight of dodecane. Next, the silicone rubber composition 7-2 is coated on the formed first elastic layer of step B-7, heated and hardened for 30 minutes at a temperature of 120° C. and a second elastic layer having a thickness of 100 μm is formed.

Step D-7: The procedure of step D-1 of Example 1 is repeated and a release layer is formed on the second elastic layer formed in step C-7.

Accordingly, a fixing member of Example 7 is prepared.

[Evaluation]

The evaluation of Example 1 is repeated for Example 7 employing the fixing member of Example 7 instead of the fixing member of Example 1. A warm-up time is measured, and after conducting test printing, gloss unevenness is visually evaluated and ranked.

Comparative Example 1

[Manufacture of a Fixing Member]

Step A-Comp1: The procedure of step A-1 of Example 1 is repeated and a base of Comparative example 1 is formed.

Step B-Comp1: A silicone rubber composition Comp1-1 is prepared by dispersing 100 parts by weight of a silicone rubber of DY35-2083 (from Dow Corning Toray Co., Ltd.), 40 parts by weight of carbon fibers of GRANOC® XN-100-05M (from Nippon Graphite Fiber Corporation), and 1.5 parts by weight of micro-balloons of Expancel® 920DE40d30 (from Japan Fillite Co., Ltd.). Next, the silicone rubber composition Comp1-1 is coated on the base of step A-Comp1, heated and hardened for 30 minutes at a temperature of 120° C., and a first elastic layer having a thickness of 250 μm is formed.

Step D-Comp1: The procedure of step D-1 of Example 1 is repeated and a release layer is formed on the first elastic layer formed in step B-Comp1.

Accordingly, a fixing member of Comparative example 1, having one elastic layer, is prepared.

[Evaluation]

The evaluation of Example 1 is repeated for Comparative example 1 employing the fixing member of Comparative example 1 instead of the fixing member of Example 1. A warm-up time is measured, and after conducting test printing, gloss unevenness is visually evaluated and ranked.

Comparative Example 2

[Manufacture of a Fixing Member]

Step A-Comp2: The procedure of step A-1 of Example 1 is repeated and a base of Comparative example 2 is formed.

Step B-Comp2: A silicone rubber composition Comp2-1 is prepared by dispersing 100 parts by weight of a silicone rubber of DY35-2083 (from Dow Corning Toray Co., Ltd.), 40 parts by weight of carbon fibers of GRANOC® XN-100-05M (from Nippon Graphite Fiber Corporation), and 1.2 parts by weight of micro-balloons of Expancel® 920DE80d30 (from Japan Finite Co., Ltd.). Next, the silicone rubber composition Comp2-1 is coated on the base of step A-Comp2, heated and hardened for 30 minutes at a temperature of 120° C., and a first elastic layer having a thickness of 200 μm is formed.

Step C-Comp2: A silicone rubber composition Comp2-2 is prepared by dispersing 100 parts by weight of a silicone rubber of DY35-2083 (from Dow Corning Toray Co., Ltd.), 60 parts by weight of carbon fibers of GRANOC® XN-100-05M (from Nippon Graphite Fiber Corporation), 1.2 parts by weight of micro-balloons of Expancel® 551DE40d42 (from Japan Fillite Co., Ltd.), and 10 parts by weight of dodecane. Next, the silicone rubber composition Comp2-2 is coated on the formed first elastic layer of step B-Comp2, heated and hardened for 30 minutes at a temperature of 120° C., and a second elastic layer having a thickness of 100 μm is formed.

Step D-Comp2: The procedure of step D-1 of Example 1 is repeated and a release layer is formed on the second elastic layer formed in step C-Comp2.

Accordingly, a fixing member of Comparative example 2, with no heat conductive sphere shaped fillers in the second elastic layer, is prepared.

[Evaluation]

The evaluation of Example 1 is repeated for Comparative example 2 employing the fixing member of Comparative example 2 instead of the fixing member of Example 1. A warm-up time is measured, and after conducting test printing, gloss unevenness is visually evaluated and ranked.

Comparative Example 3

[Manufacture of a Fixing Member]

Step A-Comp3: The procedure of step A-1 of Example 1 is repeated and a base of Comparative example 3 is formed.

Step B-Comp3: A silicone rubber composition Comp3-1 is prepared by dispersing 100 parts by weight of a silicone rubber of DY35-2083 (from Dow Corning Toray Co., Ltd.), 60 parts by weight of carbon fibers of GRANOC® XN-100-05M (from Nippon Graphite Fiber Corporation), and 1.2 parts by weight of micro-balloons of Expancel® 920DE80d30 (from Japan Fillite Co., Ltd.). Next, the silicone rubber composition Comp3-1 is coated on the base of step A-Comp3, heated and hardened for 30 minutes at a temperature of 120° C., and a first elastic layer having a thickness of 200 μm is formed.

Step C-Comp3: A silicone rubber composition Comp3-2 is prepared by dispersing 100 parts by weight of a silicone rubber of DY35-2083 (from Dow Corning Toray Co., Ltd.), 30 parts by weight of carbon fibers of GRANOC® XN-100-05M (from Nippon Graphite Fiber Corporation), 10 parts by weight of sphere shaped graphite of WF-15C (from Chuetsu Graphite Works Co., Ltd.), and 1.2 parts by weight of micro-balloons of Expancel® 551DE40d42 (from Japan Fillite Co., Ltd.). Next, the silicone rubber composition Comp3-2 is coated on the formed first elastic layer of step B-Comp3, heated and hardened for 30 minutes at a temperature of 120° C., and a second elastic layer having a thickness of 100 μm is formed.

Step D-Comp3: The procedure of step D-1 of Example 1 is repeated and a release layer is formed on the second elastic layer formed in step C-Comp3.

Accordingly, a fixing member of Comparative example 3, with a total amount of heat conductive fillers in the second elastic layer being smaller than an amount of heat conductive fillers in the first elastic layer, is prepared.

[Evaluation]

The evaluation of Example 1 is repeated for Comparative example 3 employing the fixing member of Comparative example 3 instead of the fixing member of Example 1. A warm-up time is measured, and after conducting test printing, gloss unevenness is visually evaluated and ranked.

Comparative Example 4

[Manufacture of a Fixing Member]

Step A-Comp4: The procedure of step A-1 of Example 1 is repeated and a base of Comparative example 4 is formed.

Step B-Comp4: A silicone rubber composition Comp4-1 is prepared by dispersing 100 parts by weight of a silicone rubber of DY35-2083 (from Dow Corning Toray Co., Ltd.), 40 parts by weight of carbon fibers of GRANOC® XN-100-05M (from Nippon Graphite Fiber Corporation), and 1.2 parts by weight of micro-balloons of Expancel® 920DE80d30 (from Japan Fillite Co., Ltd.). Next, the silicone rubber composition Comp4-1 is coated on the base of step A-Comp4, heated and hardened for 30 minutes at a temperature of 120° C., and a first elastic layer having a thickness of 200 μm is formed.

Step C-Comp4: A silicone rubber composition Comp4-2 is prepared by dispersing 100 parts by weight of a silicone rubber of DY35-2083 (from Dow Corning Toray Co., Ltd.), 50 parts by weight of sphere shaped graphite of WF-15C (from Chuetsu Graphite Works Co., Ltd.), 1.2 parts by weight of micro-balloons of Expancel® 551DE40d42 (from Japan Fillite Co., Ltd.), and 10 parts by weight of dodecane. Next, the silicone rubber composition Comp4-2 is coated on the formed first elastic layer of step B-Comp4, heated and hardened for 30 minutes at a temperature of 120° C., and a second elastic layer having a thickness of 100 μm is formed.

Step D-Comp4; The procedure of step D-1 of Example 1 is repeated and a release layer is formed on the second elastic layer formed in step C-Comp4.

Accordingly, a fixing member of Comparative example 4, with no heat conductive needle shaped fillers in the second elastic layer, is prepared.

[Evaluation]

The evaluation of Example 1 is repeated for Comparatives example 4 employing the fixing member of Comparative example 4 instead of the fixing member of Example 1, A warm-up time is measured, and after conducting test printing, gloss unevenness is visually evaluated and ranked.

Compositions of the above-described elastic layers of the fixing members of Examples 1 to 7 and Comparative Examples 1 to 4 are shown in Table 1. Evaluation results are shown in Table 2.

TABLE 1

| | First elastic layer | | | Second elastic layer | | | |
|---|---|---|---|---|---|---|---|
| | Needle shaped fillers (Parts by weight) | Micro-balloons (Parts by weight) | Thick-ness (μm) | Needle shaped fillers (Parts by weight) | Sphere shaped fillers (Parts by weight) | Micro-balloons (Parts by weight) | Thick-ness (μm) |
| Ex. 1 | 40 | 1.5 | 150 | 40 | 10 | 1.5 | 100 |
| Ex. 2 | 40 | 1.2 | 200 | 45 | 15 | 1.2 | 100 |
| Ex. 3 | 40 | 1.5 | 200 | 40 | 20 | 1.2 | 50 |
| Ex. 4 | 40 | 1.2 | 200 | 40 | 10 | 1 | 100 |
| Ex. 5 | 40 | 1.5 | 200 | 40 | 5 | 1.5 | 50 |
| Ex. 6 | 35 + 5 | 1 | 200 | 35 + 5 | 5 | 1 | 100 |
| Ex. 7 | 35 + 5 | 1 | 200 | 35 + 5 | 5 | 1 | 100 |
| Comp. Ex. 1 | 40 | 1.5 | 250 | | | | |
| Comp. Ex. 2 | 40 | 1.2 | 200 | 60 | | 1.2 | 100 |
| Comp. Ex. 3 | 60 | 1.2 | 200 | 30 | 10 | 1.2 | 100 |
| Comp. Ex. 4 | 40 | 1.2 | 200 | | 50 | 1.2 | 100 |

TABLE 2

| | Warm-up time Rank evaluation | Uneven gloss Rank evaluation |
|---|---|---|
| Ex. 1 | 2 | 3 |
| Ex. 2 | 2 | 4 |
| Ex. 3 | 2 | 4 |
| Ex. 4 | 2 | 4 |
| Ex. 5 | 2 | 4 |
| Ex. 6 | 2 | 4 |
| Ex. 7 | 2 | 4 |
| Comp. Ex. 1 | 2 | 1 |
| Comp. Ex. 2 | 2 | 2 |
| Comp. Ex. 3 | 1 | 1 |
| Comp. Ex. 4 | 1 | 1 |

Evaluation criteria are as follows.

<Warm-Up Time>

Rank 1: Warm-up time longer than a fixing member pre-installed in the fixing device of Imagio MP C5002 (from RICOH Company, Ltd.). Evaluated as poor.

Rank 2: Warm-up time shorter than (less than) a fixing member pre-installed in the fixing device of Imagio MP C5002 (from RICOH Company, Ltd.). Evaluated as good.

<Evaluation of Gloss Unevenness>

Rank 1: Extreme uneven gloss is seen, and is an abnormal image. Evaluated as poor.

Rank 2: Uneven gloss is seen, and is an abnormal image. Evaluated as poor.

Rank 3: Uneven gloss is seen though is within an allowable level (not an abnormal image). Evaluated as good.

Rank 4: Uneven gloss is not seen. Evaluated as good.

According to the foregoing, the second elastic layer of the fixing member of Example 1 provided at the outer side of the fixing member has a flexible structure, high heat storage, and attains higher heat dispersion. Accordingly, warm-up speed is fast and uneven gloss of the solid image is suppressed. With respect to each of the fixing members of Examples 2 to 7, the thickness of the second elastic layer is half or Less of the first elastic layer. Accordingly, Examples 2 to 7 have further flexibility and uneven gloss of the solid image is not generated.

By contrast, the fixing member of Comparative Example 1 does not have a structure with high heat storage. Accordingly, due to insufficient amount of heat, uneven gloss is generated.

Regarding the fixing member of Comparative Example 2, the second elastic layer has a structure with low flexibility. Accordingly, due to a lack of following capability of the fixing member of Comparative Example 2, uneven gloss is generated. Regarding the fixing member of Comparative Example 3, the second elastic layer has a structure in which heat dispersion is difficult. Accordingly, warm-up speed is slow and uneven gloss is generated due to insufficient amount of heat. Regarding the fixing member of Comparative Example 4, the second elastic layer has a structure in which heat dispersion is difficult. Accordingly, warm-up speed is slow and uneven gloss is generated due to insufficient amount of heat.

Thus, the fixing member according to an embodiment of the present invention is capable of high-speed warm-up and suppresses generation of image failure.

What is claimed is:

1. A fixing member used for fixing toner, comprising:

a base;

a first elastic layer overlaid on an outer circumference of the base, the first elastic layer formed of a silicone rubber composition including a heat conductive filler and a micro-balloon, the heat conductive filler of the first elastic layer is a heat conductive needle shaped filler;

a second elastic layer overlaid on an outer circumference of the first elastic layer, the second elastic layer formed of a silicone rubber composition including a heat conductive filler and a micro-balloon, the heat conductive filler of the second elastic layer is a heat conductive needle shaped filler and a heat conductive sphere shaped filler; and a release layer overlaid on an outer circumference of the second elastic layer, wherein an amount of the heat conductive filler of the second elastic layer in the silicone rubber composition of the second elastic layer is larger than an amount of the heat conductive filler of the first elastic layer in the silicone rubber composition of the first elastic layer, and wherein, in the second elastic layer, a mixture ratio of heat conductive needle shaped filler to heat conductive sphere shaped filler is in a range of from 10:1 to 10:10.

2. The fixing member of claim 1, wherein the second elastic layer has a thickness that is half or less of a thickness of the first elastic layer.

3. The fixing member of claim 1, wherein the heat conductive needle shaped filler is a carbon fiber and the heat conductive sphere shaped filler is one or more selected from the group consisting of sphere shaped graphite, aluminum nitride, and boron nitride.

4. A fixing device comprising the fixing member of claim 1.

5. An image forming apparatus comprising the fixing device of claim 4.

6. A fixing member used for fixing toner, comprising:

a base;

a first elastic layer overlaid on an outer circumference of the base, the first elastic layer formed of a silicone rubber composition including a heat conductive filler and a micro-balloon, the heat conductive filler of the first elastic layer is a heat conductive needle shaped filler;

a second elastic layer overlaid on an outer circumference of the first elastic layer, the second elastic layer formed of a silicone rubber composition including a heat conductive filler and a micro-balloon, the heat conductive filler of the second elastic layer is a heat conductive needle shaped filler and a heat conductive sphere shaped filler; and a release layer overlaid on an outer circumference of the second elastic layer, wherein an amount of the heat conductive filler of the second elastic layer in the silicone rubber composition of the second elastic layer is larger than an amount of the heat conductive filler of the first elastic layer in the silicone rubber composition of the first elastic layer, wherein, in the second elastic laver, a mixture ratio of heat conductive needle shaped filler to heat conductive sphere shaped filler is in a range of from 10:1 to 10:10, wherein the second elastic layer has a thickness that is half or less of a thickness of the first elastic layer, and wherein the heat conductive needle shaped filler is a carbon fiber and the heat conductive sphere shaped filler is one or more selected from the group consisting of sphere shaped graphite, aluminum nitride, and boron nitride.

7. A fixing device comprising the fixing member of claim 6.

8. The fixing member of claim 1, wherein the heat conductive needle shaped filler has an average fiber length in a range from 1 μm to 500 μm; and the heat conductive sphere shaped filler has an average particle diameter in a range from 1 μm to 50 μm.

* * * * *